US007562712B2

(12) United States Patent
Cho et al.

(10) Patent No.: US 7,562,712 B2
(45) Date of Patent: Jul. 21, 2009

(54) SETTING TOOL FOR HYDRAULICALLY ACTUATED DEVICES

(75) Inventors: Brian W. Cho, Sugar Land, TX (US); Philippe Gambier, Houston, TX (US); John R. Whitsitt, Houston, TX (US); Arin Basmajian, Houston, TX (US); Jose F. Garcia, Sugar Land, TX (US); Youel G. Hilsman, III, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 491 days.

(21) Appl. No.: 10/906,213

(22) Filed: Feb. 9, 2005

(65) Prior Publication Data

US 2005/0230122 A1 Oct. 20, 2005

Related U.S. Application Data

(60) Provisional application No. 60/521,395, filed on Apr. 16, 2004.

(51) Int. Cl.
*E21B 23/04* (2006.01)
*E21B 43/00* (2006.01)

(52) U.S. Cl. ..... 166/319; 166/332.1; 166/65.1; 166/53; 166/381; 166/373

(58) Field of Classification Search ..... 166/250.15, 166/381, 383, 386, 387, 65.1, 66, 53, 66.6, 166/373, 374, 319, 332.1, 317
See application file for complete search history.

(56) References Cited

U.S. PATENT DOCUMENTS 2,979,904 A * 4/1961 Royer ..... 60/632
3,269,462 A * 8/1966 Voetter ..... 166/100
3,577,783 A * 5/1971 Whitten et al. ..... 73/152.02
4,796,699 A * 1/1989 Upchurch ..... 166/250.17
5,101,904 A * 4/1992 Gilbert ..... 166/319
5,101,907 A * 4/1992 Schultz et al. ..... 166/386
5,146,983 A * 9/1992 Hromas et al. ..... 166/66.7
5,203,414 A 4/1993 Hromas et al.
5,392,856 A 2/1995 Broussard, Jr.
5,819,853 A * 10/1998 Patel ..... 166/373
5,839,508 A * 11/1998 Tubel et al. ..... 166/65.1
5,893,413 A * 4/1999 Lembcke et al. ..... 166/66.6
6,050,342 A 4/2000 Ramsey
6,439,306 B1 * 8/2002 Patel ..... 166/264
6,550,551 B2 4/2003 Brunnert et al.

(Continued)

FOREIGN PATENT DOCUMENTS

GB 2280013 A 1/1995

(Continued)

*Primary Examiner*—Shane Bomar
(74) *Attorney, Agent, or Firm*—Jeremy P. Welch; James L. Kurka

(57) ABSTRACT

A tool is actuated in a well based on one or more issued commands being interpreted and implemented by the apparatus. The apparatus comprises a power generation module that multiplies pressure delivered downhole to enable actuation of the tool without requiring delivery of the higher actuation pressure along the entire wellbore. An actuation module may be used in combination with the power generation module to control operation of the power generation module in response to command signals sent downhole.

26 Claims, 6 Drawing Sheets

U.S. PATENT DOCUMENTS

| | | | | |
|---|---|---|---|---|
| 6,564,876 | B2 | 5/2003 | Vaynshteyn et al. | |
| 6,684,950 | B2 | 2/2004 | Patel | |
| 7,000,705 | B2 * | 2/2006 | Buyers et al. | 166/383 |
| 2002/0070015 | A1 | 6/2002 | Armell et al. | |
| 2004/0026086 | A1 * | 2/2004 | Patel | 166/373 |
| 2004/0045724 | A1 * | 3/2004 | Buyers et al. | 166/387 |
| 2007/0056745 | A1 * | 3/2007 | Contant | 166/382 |

FOREIGN PATENT DOCUMENTS

| | | | |
|---|---|---|---|
| GB | 2300441 | A | 11/1996 |

* cited by examiner

SETTING TOOL FOR HYDRAULICALLY ACTUATED DEVICES

This application claims the benefit of U.S. Provisional Application 60/521,395 filed on Apr. 16, 2004.

BACKGROUND

1. Field of Invention

The present invention pertains to a setting tool used in a well, and particularly to a setting tool for hydraulically actuated devices.

2. Related Art

It is often desirable to actuate a downhole tool such as a packer, valve, or test device, for example, after placing the tool in a desired location in a well. Typical prior art devices require a separate intervention run using a tool such as a mechanical actuator run on a slickline or an electrical actuator run on a wireline. Other existing tools require a communication link to the surface such as a hydraulic or electrical control line run in with the tool.

SUMMARY

The present invention provides for an apparatus and method to actuate a tool in a well based on one or more issued commands being interpreted and implemented by the apparatus.

Advantages and other features of the invention will become apparent from the following description, drawings, and claims.

DETAILED DESCRIPTION

Figure 1:
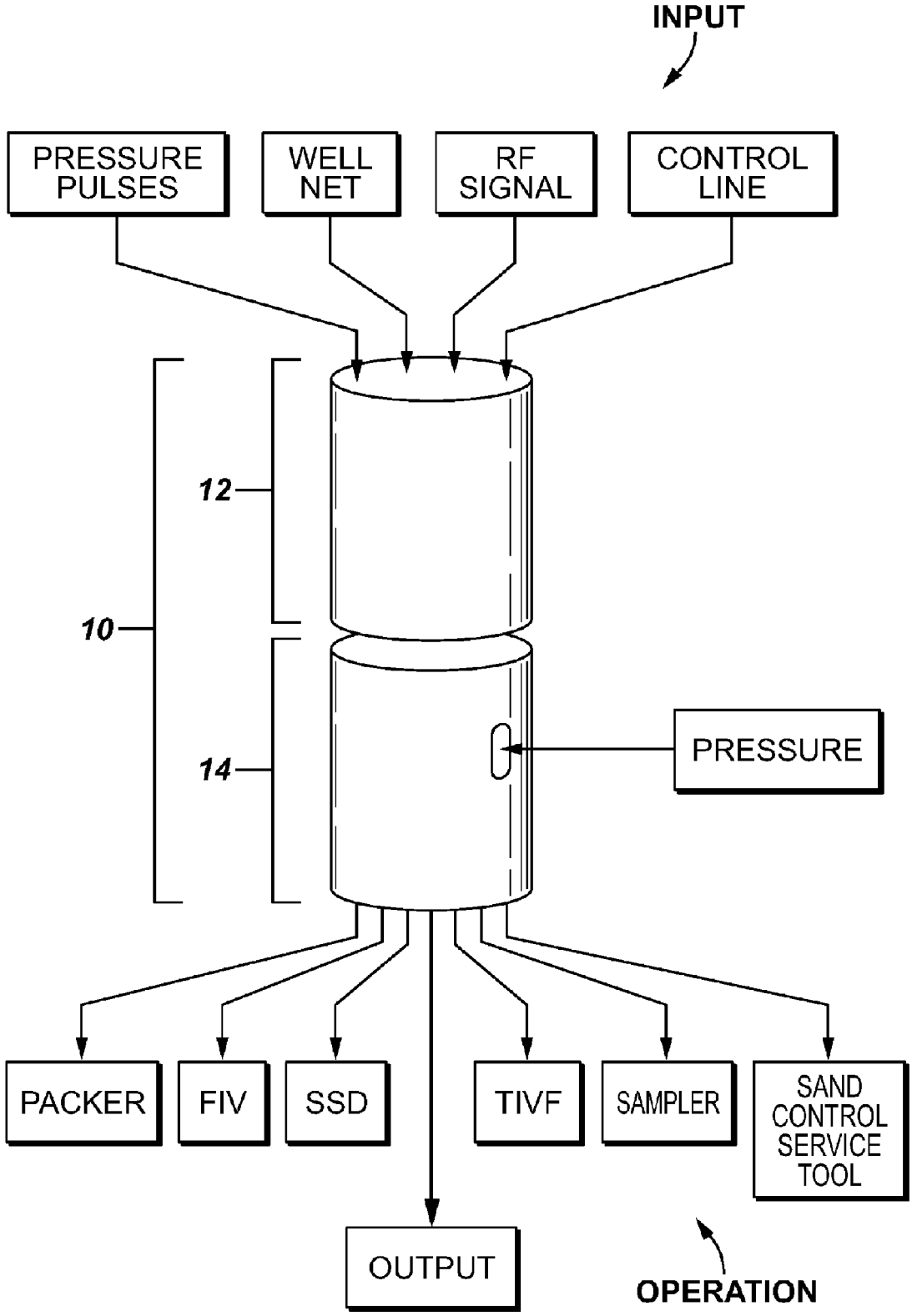
FIG. 1 shows a block diagram of a setting tool for hydraulically actuated devices constructed in accordance with the present invention.

FIG. 1 shows a setting tool 10. Setting tool 10 is preferably a modular tool designed to actuate a completion element or downhole device such as a packer, valve, sampler, or other downhole apparatus without intervention. This may be achieved, for example, using signals such as pressure pulses, electric or electromagnetic signals, or by delivering pressure downhole. Other input signals such as acoustic or seismic signals could be used. Setting tool 10 can respond to those various inputs and can be used in a large number of applications. The input signals may be sent through tubing, through fluid in the tubing or annulus (including air), through a control line or fluid in the control line, through earth formations, or through casing. Setting tool 10 can be used in a variety of environments, with different sized casings, and across various ranges of hydrostatic pressure and temperature.

Figure 2:
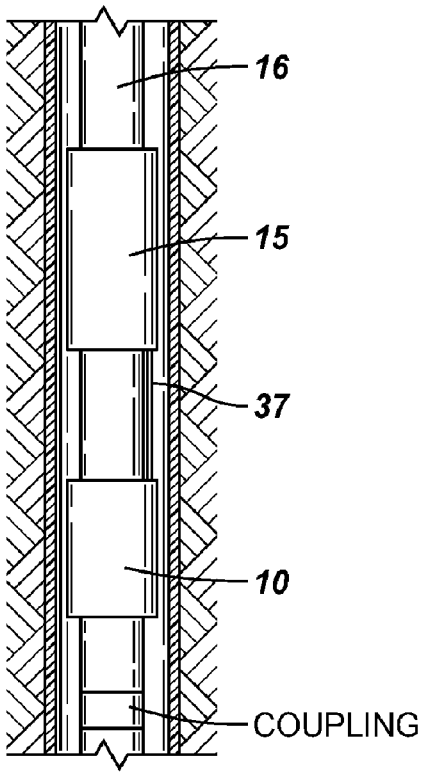
FIG. 2 shows a schematic view of an example completion assembly having the setting tool of FIG. 1.

Setting tool 10 is preferably not integral with a specific application tool such as the packer 15 shown in FIG. 2, though it could be so incorporated if desired. The embodiment shown in FIG. 1 has a sensing and actuation module 12 and a power generation module 14. Sensing and actuation module 12, when present, senses the input command and initiates actuation of the downhole device via the actuation module. The actuation module causes power generation module 14 to act as described further below, thereby activating the desired downhole device. This allows a wide range of functionality for setting tool 10. Setting tool 10 can operate in a wide range of hydrostatic pressures, and can be sensitive, say, to a pressure pulse of only a few hundred pounds per square inch. Setting tool 10 can be variously conveyed into the well, including on tubing 16. Setting tool 10 may also be used having just the power generation module 14, using, for example, a system of rupture discs that allow power generation module 14 to actuate the downhole device upon rupture of the discs.

Figure 3:
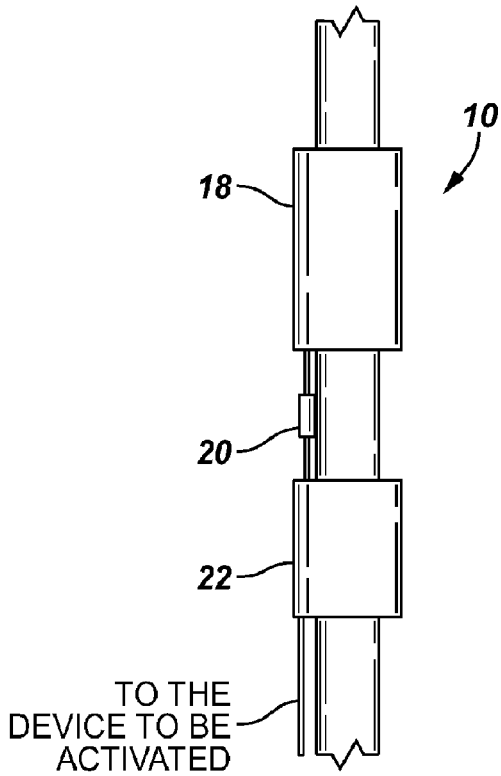
FIG. 3 shows a schematic view of an embodiment of the setting tool of FIG. 1.
Figure 4:
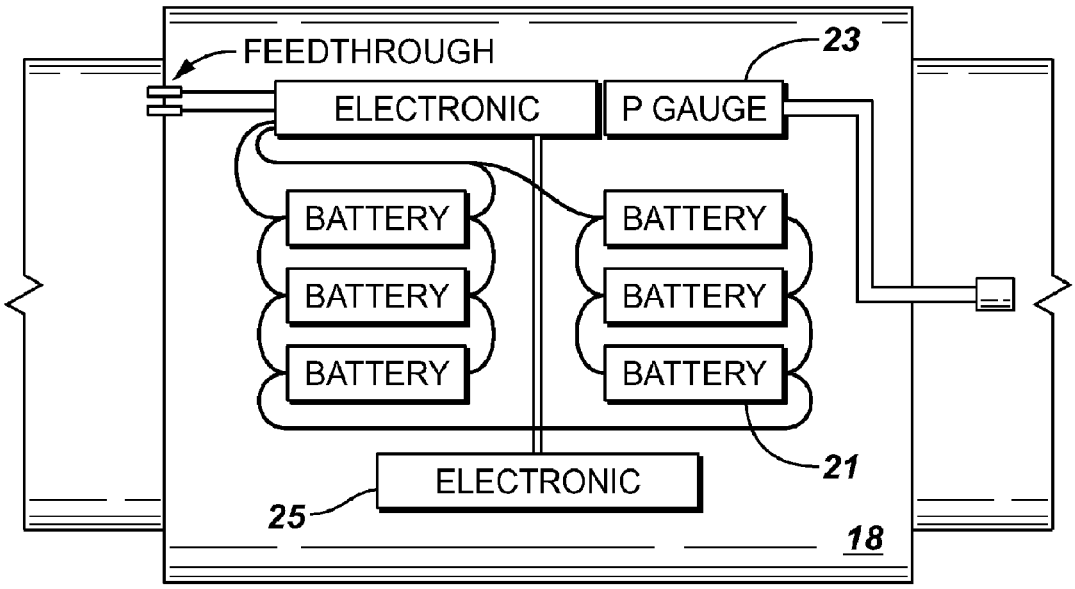
FIG. 4 shows a schematic view of an embodiment of a control command compartment used in the setting tool of FIG. 1.

FIG. 3 shows an embodiment of setting tool 10 having three main modules: a command compartment 18, a trigger 20, and a power module or intensifier 22. Command compartment 18 (FIG. 4) preferably comprises batteries 21, sensors 23 such as pressure gauges, and microprocessors 25 or other electronic devices. Trigger 20 can be strategically placed in the well to increase the reliability of setting tool 10. Trigger 20 can be electronically controlled to actuate the completion element or downhole device at some desired time.

Figure 5:
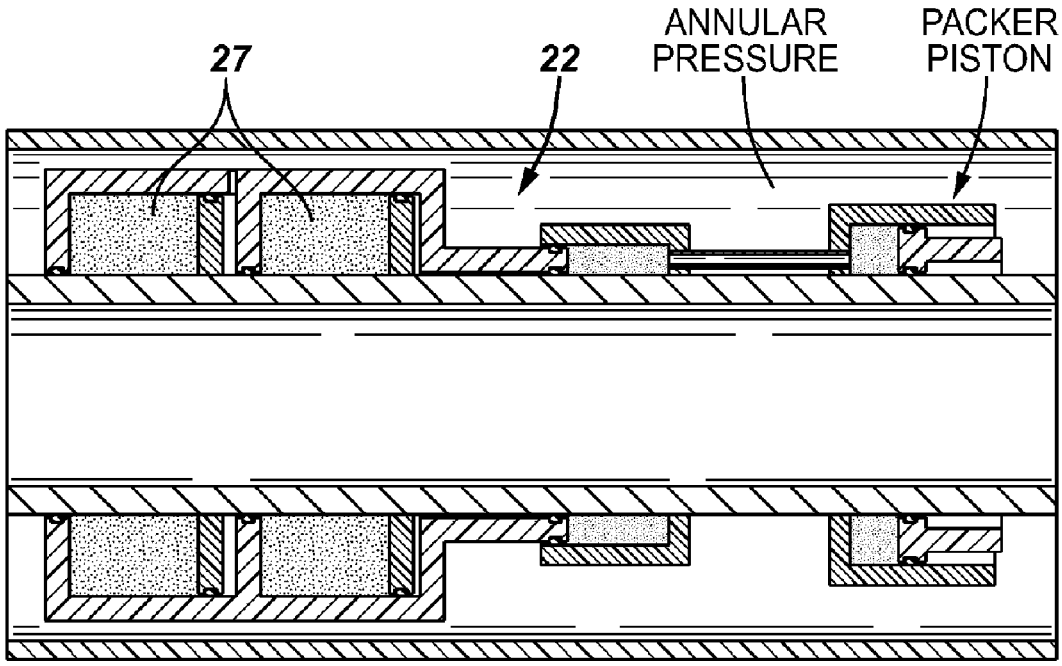
FIG. 5 shows a schematic view of an embodiment of a power generation module used in the setting tool of FIG. 1.
Figure 12:
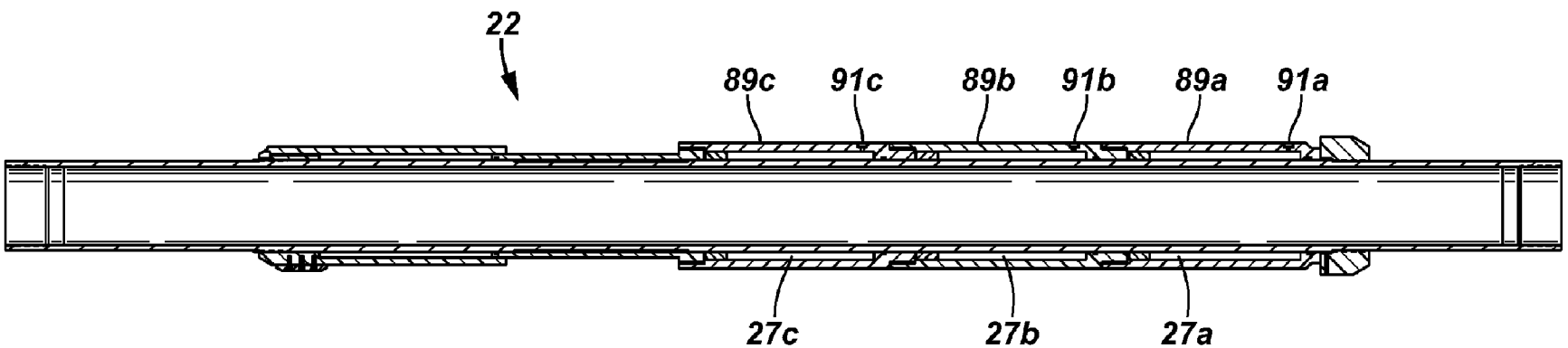
FIG. 12 shows a schematic view of an alternative embodiment of a power generation module used in the setting tool of FIG. 1.

Intensifier 22 (FIG. 5) can have a series of atmospheric chambers 27*a*, 27*b* and 27*c*, preferably in series, to produce a multiplier effect on the pressure delivered. In some embodiments, intensifier 22 is linked to the hydrostatic pressure acting on it and delivers a multiple of that pressure as its output. The pressure delivered may also be increased or decreased depending on the number of pistons 89 used and the hydrostatic pressure conditions. As shown in FIG. 12, a system of rupture discs 91 (91*a*, 91*b*, and 91*c*) may be used to allow the tool to operate intelligently and reduce operator error. The discs 91 act as plugs dependent on the hydrostatic pressure and allow the desired number of pistons 89 (89*a*, 89*b*, and 89*c*) to be used with no operator intervention. At low pressures, all pistons 89 are used. As the hydrostatic pressure increases, rupture disc 91*a* ruptures, thereby flooding chamber 27*a* and deactivating piston 89*a*. As the hydrostatic pressure further increases, rupture disc 91*b* ruptures and only piston 89*c* is used in actuation. In this manner, the operator does not have to choose which piston to use. Rather, the rupture discs will allow proper selection of the pistons per downhole conditions.

Figure 6:
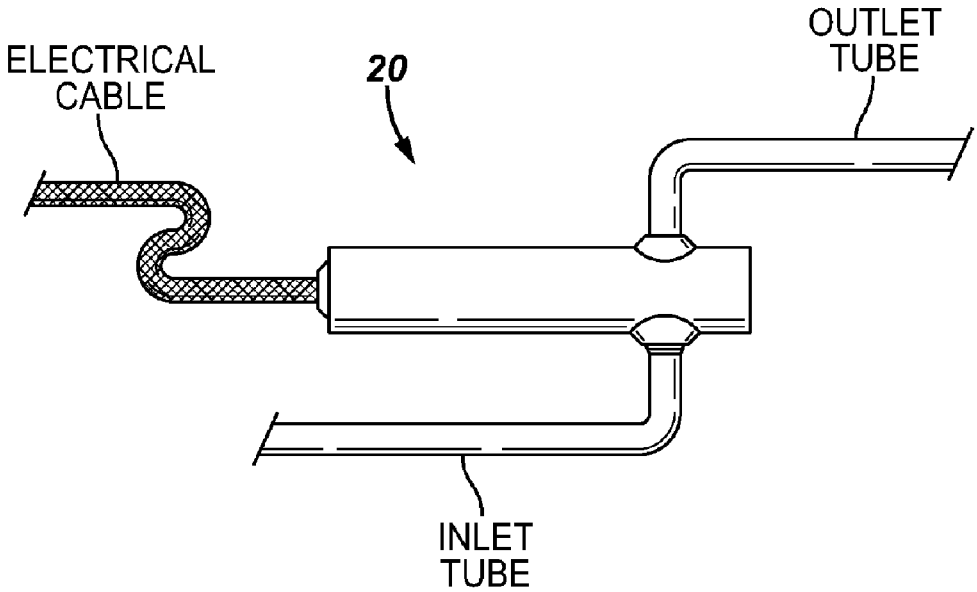
FIG. 6 shows a schematic view of an embodiment of a trigger device used in the setting tool of FIG. 1.

Trigger 20 is preferably a normally closed valve with a cartridge-actuated device that may be opened when desired. It is preferably located between intensifier 22 and the completion element or downhole tool to be set. That placement allows setting tool 10 to always operate in a "safe" mode as it sets the completion element. FIG. 6 is an example of one embodiment of trigger 20. If trigger 20 fails to operate, rupture discs 91 may be used to enable the completion element to be set by simply pressuring up the tubing.

Figure 7:
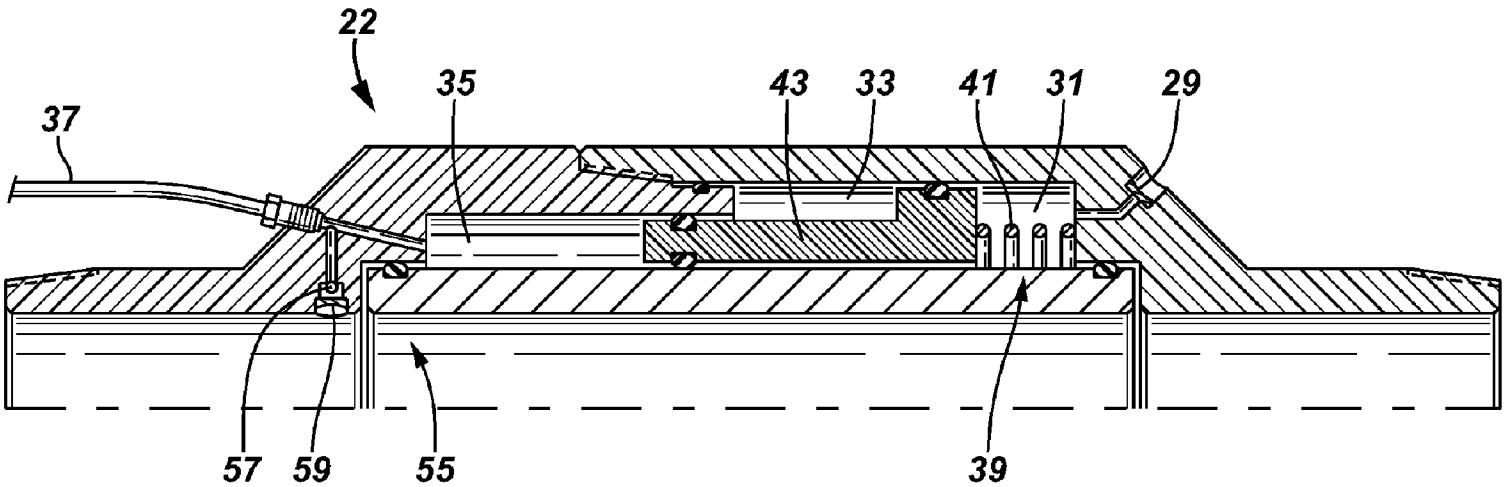
FIG. 7 shows a schematic view of an alternative embodiment of a power generation module used in the setting tool of FIG. 1.

The power module 22 shown in FIG. 7 is a module that is generally placed below a hydraulically-actuated device and operates in response to hydrostatic pressure upon rupturing a burst (rupture) disc. A first burst disc 29 is ruptured with surface activation pressure. The hydrostatic pressure plus the applied pressure enters a first chamber 31 and pushes a piston 43 such that it tries to collapse a second (atmospheric) chamber 33. Since the piston area of first chamber 31 is larger than the piston area in a third chamber 35, the pressure in third chamber 35 is intensified. The intensified pressure from third chamber 35 is communicated to the hydraulically-actuated device via a control line 37.

A thermal compensation feature 39 allows for fluid expansion as transport fluid heats up on the way downhole, and is achieved by ensuring there is sufficient room for piston 43 to move (to the right) as fluid in third chamber 35 expands (e.g., with temperature). To create this piston travel distance, a spring 41 is placed in chamber 31. Spring 41 may also be activated during assembly if third chamber 35 is overfilled. In this case, when the pressure in third chamber 35 is released, spring 41 pushes piston 43 back to the proper position so that minimum travel is assured.

Figure 8:
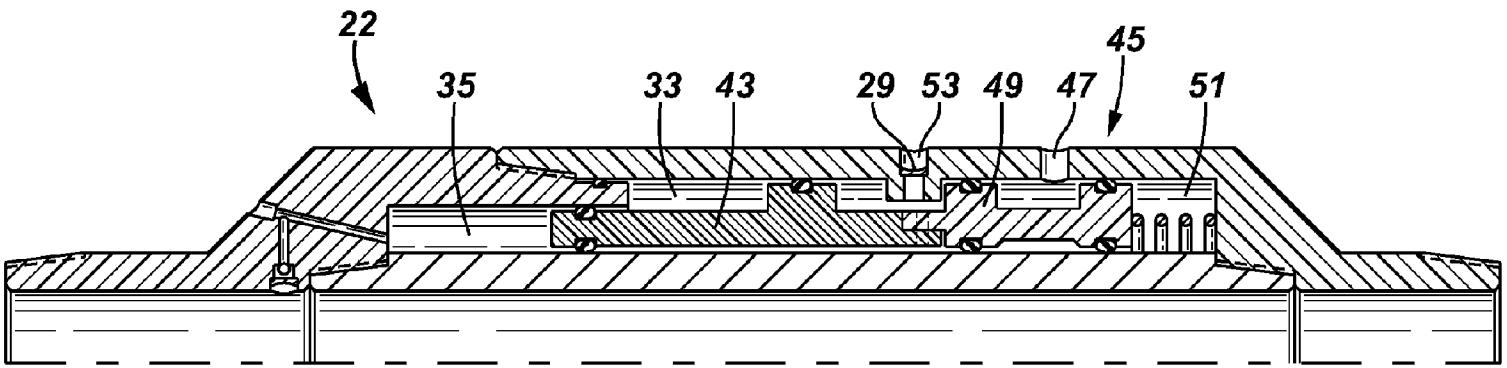
FIG. 8 shows a schematic view of an alternative embodiment of a power generation module used in the setting tool of FIG. 1.

A full throttle feature 45 is an option shown in FIG. 8, and allows setting through large ports 47. When the first burst disc 29 is ruptured, piston 43 and a full throttle piston 49 travel away from each other. Full throttle piston 49 moves to the right, collapsing a fourth chamber 51 and at the same time opening up greater access to setting piston 43 via ports 47. This allows the stroking of setting piston 43 to be accomplished in the "full throttle mode" as opposed to setting through the ruptured burst disc port 53.

In the embodiments shown in FIGS. 7 and 8, the internal pistons 43, 49 are balanced so there are no undue stresses acting on the internal seals (O-rings). This increases the reliability of setting tool 10. All chambers have a test port to verify the seals are functional prior to running in hole.

A secondary setting feature 55 is shown in FIG. 7 as an arrangement of check valve 57 and a second burst disc 59. Check valve 57 protects second burst disc 59 from internal pressure from control line 37. Also the arrangement maintains a small, trapped atmospheric chamber between check valve 57 and second rupture disc 59. This makes it possible to rupture second burst disc 59 with minimal applied pressure. Without the trapped atmospheric pressure, the full rating of second burst disc 59 would need to be applied at the surface. In many applications that may not be possible.

Figure 9:
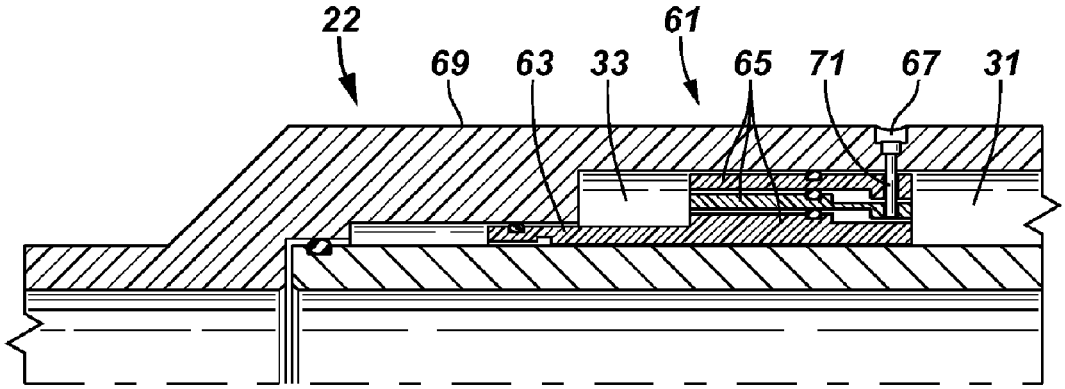
FIG. 9 shows a schematic view of an alternative embodiment of a power generation module used in the setting tool of FIG. 1.

An adjustable setting area feature 61 that allows the ratio of pressure intensification of intensifier 22 to be adjusted is shown in FIG. 9. This design splits the piston into two portions having a small piston 63 and at least one large piston 65. The embodiment shown has multiple large pistons 65. Through a port 67 in a housing 69 of intensifier 22, a rod 71 is installed into one or more of the large pistons 65. Depending on the length of rod 71, various pistons 65 are restrained from movement. That allows the pressure intensification to be easily adjusted.

Figure 10:
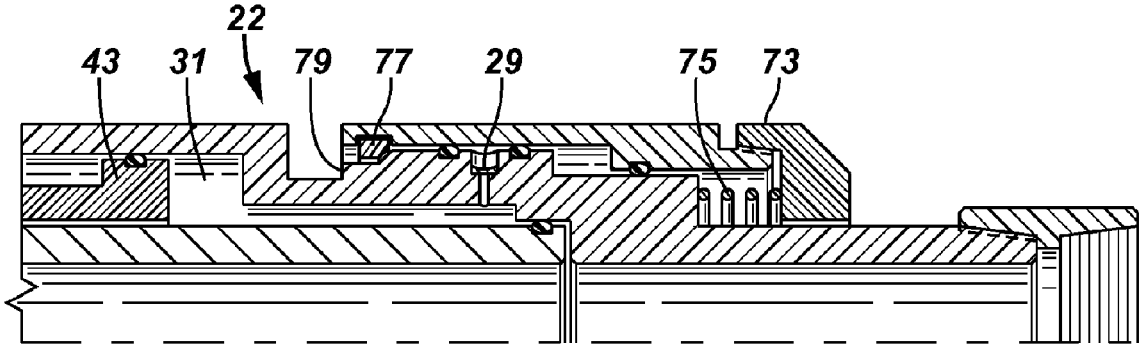
FIG. 10 shows a schematic view of an alternative embodiment of a power generation module used in the setting tool of FIG. 1

An adjustable protection sleeve 73 is shown in FIG. 10. This feature is an option for use in high-pressure applications. Protection sleeve 73 isolates burst disc 29 in high hydrostatic pressure conditions (such as may result from heavy fluid or a pressure test). Typically, the last step prior to setting a packer presents the highest-pressure condition: the tubing hanger pressure test. Prior to running setting tool 10 downhole, protection sleeve 73 can be set to a position corresponding to the anticipated hydrostatic and test pressure conditions by compressing or extending an adjustment spring 75. The C-ring 77 keeps protection sleeve 73 in a closed position. Under the high-pressure hydrostatic conditions adjustment spring 75 provides sufficient force to keep protection sleeve 73 in the closed state, isolating first burst disc 29. However, during the tubing hanger pressure test, the hydrostatic and applied pressures overcome the spring force and move protection sleeve 73 to the left, dropping C-ring 77 into a recess 79. When pressure is released, first burst disc 29 is uncovered and intensifier 22 works as described above.

Figure 11:
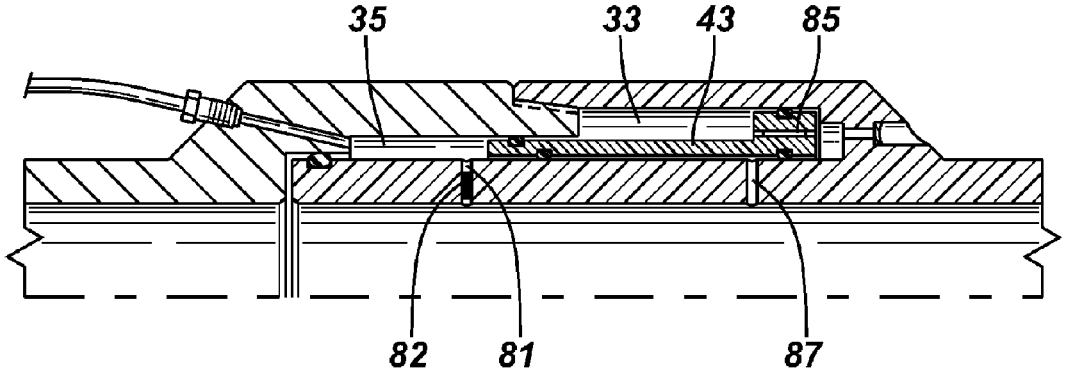
FIG. 11 shows a schematic view of an alternative embodiment of a power generation module used in the setting tool of FIG. 1.

The embodiment shown in FIG. 11 shows an open port concept in which chamber 35 is in fluid communication with the exterior of intensifier 22 via autofill port 81. A filter 82 may be placed in port 81 to prevent particulates in the well fluid from entering chamber 35 and control line 37. A velocity valve 85 near the end of piston 43 may be used to avoid premature setting of the downhole tool. Equalizing port 87 prevents an atmospheric chamber from becoming trapped in chamber 33.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A modular setting tool for use in a well comprising:

a sensing and actuation module receptive to at least one input source; and a power generation module acting upon an output from the sensing and actuation module to supply sufficient energy to set a downhole tool in the well, the power generation module comprising:

a housing having an inlet port and an outlet port in fluid communication with a chamber disposed within the housing;

a piston moveably disposed in the chamber, the piston having a first surface area on the end nearest the inlet port larger than a second surface area on the opposite end of the piston near the outlet port; and a control line in fluid communication with the outlet port.

2. The setting tool of claim 1 in which the at least one input source is a pressure pulse, an electromagnetic signal, an acoustic signal, or a pressure source.

3. The setting tool of claim 1 in which the sensing and actuation module comprises a command compartment and a trigger.

4. The setting tool of claim 3 in which the command compartment comprises a battery, a sensor, and a microprocessor.

5. The setting tool of claim 4 in which the sensor senses a pressure pulse, an electromagnetic signal, an acoustic signal, or a sustained pressure.

6. The setting tool of claim 1 in which there is a plurality of pistons arranged in series and having an ultimate piston to further amplify the pressure applied by the ultimate piston.

7. The setting tool of claim 1 in which the piston collapses an atmospheric chamber as the piston is displaced.

8. The setting tool of claim 1 further comprising one or more rupture disks disposed in the sensing and actuation module.

9. The setting tool of claim 1 in which the power generation module further comprises a rupture disk disposed in the inlet port.

10. The setting tool of claim 1 in which the power generation module further comprises a back-up actuation device.

11. The setting tool of claim 10 in which the back-up actuation device comprises an auxiliary rupture disk.

12. The setting tool of claim 11 in which the back-up device further comprises a check valve.

13. The setting tool of claim 1 in which the power generation module further comprises a compensation feature.

14. The setting tool of claim 13 in which the compensation feature is a spring.

15. The setting tool of claim 1 in which the power generation module further comprises a full throttle feature.

16. The setting tool of claim 15 in which the full throttle feature comprises a full throttle piston disposed in the chamber and a full throttle port in the housing.

17. The setting tool of claim 1 in which the power generation module has an adjustable setting feature.

18. The setting tool of claim 17 in which the adjustable setting feature comprises at least two pistons in which a first piston operates alone or in conjunction with the other pistons to intensify the pressure applied by the first piston.

19. The setting tool of claim 18 in which the other pistons are selectively enjoined from moving with the first piston via a pin inserted through openings in the pistons.

20. The setting tool of claim 1 in which the power generation module further comprises:

a rupture disk disposed in the inlet port; and a sleeve to protect the rupture disk from premature rupture.

21. The setting tool of claim 20 in which the power generation module further comprises an adjustment spring.

22. The setting tool of claim 1 in which the power generation module further comprises an open port to allow fluid communication between the exterior of the housing and the outlet port.

23. The setting tool of claim 22 in which the power generation module further comprises a filter disposed in the open port.

24. The setting tool of claim 22 in which the power generation module further comprises an equalization port to allow fluid communication between the exterior of the housing and a central region of the chamber.

25. The setting tool of claim 1 in which the power generation module further comprises a velocity valve.

26. The setting tool of claim 1 in which the downhole tool is a valve, a packer, a flow control device, or a sampler.

* * * * *